United States Patent [19]

Kille

[11] Patent Number: 5,012,612

[45] Date of Patent: May 7, 1991

[54] GATE

[76] Inventor: Norbert Kille, Möllner Landstrasse 41, D-2056 Glinde, Fed. Rep. of Germany

[21] Appl. No.: 342,140

[22] Filed: Apr. 24, 1989

[30] Foreign Application Priority Data

Apr. 26, 1988 [DE] Fed. Rep. of Germany ..... 3814005
Apr. 26, 1988 [DE] Fed. Rep. of Germany ..... 3814012
Sep. 28, 1988 [DE] Fed. Rep. of Germany ..... 3832825

[51] Int. Cl.[5] ..... E05D 15/58

[52] U.S. Cl. ..... 49/254; 49/49; 49/233; 49/257; 49/260

[58] Field of Search ..... 49/254, 257, 260, 233, 49/49, 35, 258, 259, 255, 256

[56] References Cited

U.S. PATENT DOCUMENTS

| | | | |
|---|---|---|---|
| 403,401 | 5/1889 | Tibbs | 49/233 |
| 547,391 | 10/1895 | Campany | 49/254 |
| 629,075 | 7/1899 | Helton | 49/256 X |
| 1,416,651 | 5/1922 | Lanfair | 49/255 |
| 1,775,681 | 9/1930 | Marino | 49/256 |
| 1,911,405 | 5/1933 | Taylor et al. | 49/254 |
| 2,109,286 | 2/1938 | Cubby | 49/254 X |
| 2,590,028 | 3/1952 | Miller | 49/260 X |
| 3,316,677 | 5/1967 | Danin | 49/254 |
| 3,820,282 | 6/1974 | Kornylak | 49/255 |
| 3,968,596 | 7/1976 | Danin | 49/49 |
| 4,457,105 | 7/1984 | Danin | 49/49 |
| 4,679,353 | 7/1987 | Langenbach et al. | 49/254 X |

*Primary Examiner*—Philip C. Kannan
*Attorney, Agent, or Firm*—Lane, Aitken & McCann

[57] ABSTRACT

Gate, particularly for entrance ways, roads, or the like, with a barrier which can be pivoted in such a way that the tip of the barrier executes a purely horizontal motion when entering its closed position and that, when the gate is closed, the tip of the barrier is positioned within a fully closed casing to protect against unauthorized opening of the gate.

16 Claims, 6 Drawing Sheets

GATE

The invention relates to a gate, particularly for entrance ways, roads, or the like, with a barrier which is swivel-mounted near one of its ends so that it can be rotated approximately 90° perpendicular to its longitudinal axis by means of winch and which is equipped with a drive and drive mechanism for the purpose of controlled pivoting of the barrier.

The invention also relates to a gate, particularly for entrance ways, roads, or the like, with a gatepost and with a barrier which is articulated with a guide bar on its end closest to the gatepost and which can be rotated around the guide bar's stationary pivot on the gatepost.

The swinging motion imparted to barrier gates must fulfill several conditions. The opening movement must be executed with relative speed, whereas the transitional movement of the barrier into vertical position should occur gradually. The closing process should be a relatively slow one. In both cases the objective is to achieve a smooth transitional movement. Furthermore, it should be possible to firmly secure the barrier in both of its terminal positions.

Gates of the type described above are known to the prior art (DE-OS 36 24 973). In such gates the barrier has the form of a diagonally extending support, which is attached in a fixed way to the lower portion of the gatepost. On the gatepost side the end of the barrier is guided in a completely vertical direction by rollers in the C section of the gatepost. To be sure, this type of barrier motion achieves a certain spatial economy with respect to the maximum height relative to the blocking width of the gate, but the motion of the barrier is poor both during opening and closing of the gate and falls far short of what Is expected by gate operators. Consequently, the known gate is suitable only for manual operation. In addition, the support that extends diagonally and downward from the gatepost can be easily damaged by automobiles, so that the functional capability of such gates is questionable. When the gate is closed, the unattached end of the barrier, the barrier tip, usually rests on a mount which is open at the top. This type of mount, however, does not provide optimal protection against unauthorized opening of the gate. Thus, there is a need to secure the free end of the barrier within a casing closed on all sides, particularly from the top.

The invention addresses the problem of creating a gate that permits both the actual swinging motion of the barrier and the unimpeded insertion of the barrier into a mounting which is closed on all sides, but particularly at the top.

The basic principle of the invention is that when the barrier begins to open, the tip of the bar executes an axial motion that allows bar tip to be released from the casing and allows the actual swinging movement of the barrier to proceed. In closed position the barrier cannot be moved or even lifted, thereby providing a gate that is protected against vandalism.

Any control and drive device that can impart this axial motion to the barrier comes into consideration, thus both motor drives and manual drives.

One embodiment of the invention relates to a gate, particularly for entrance ways, roads, or the like, with a gatepost and with a barrier which can be pivoted at its gatepost end by means of a guide bar articulated with the barrier and rotating around a stationary pivot on the gatepost, which gate is distinguished by the fact that the guide bar is articulated by means of a fixed mounting above the closed barrier and can be swung by means of a swivel drive through an angle of approx. 120° to 150° and that another guide bar is articulated with the gatepost end of the harrier, the other end of the guide bar being permanently articulated above the closed barrier.

Another embodiment of the invention relates to a gate, particularly for entrance ways, roads, or the like, with a barrier which is swivel-mounted near one of its ends so that it can be rotated 90° perpendicular to its longitudinal axis by means of a winch, and with a drive motor and drive mechanism for the purpose of swinging the barrier, wherein the gate is distinguished by the fact that the barrier is so mounted as to allow longitudinal motion relative to the winch and that a drive cam, projection, or the like which runs in a stationary cam track is positioned near the mounted end of the barrier; and that when the barrier is in a closed position, the cam track displays a more or less horizontal element, a curvilinear transition piece, and an element with vertical components, as well as a curvilinear mouth projecting horizontally.

In an alternative version this gate can have a form such that the barrier is moved longitudinally within a casing that encloses the barrier; the casing, in turn, along with the winch, can be swung perpendicular to its pivot.

Another embodiment of the invention relates to a gate, particularly for entrance ways, roads, or the like, with a gatepost and with a barrier, the gatepost end of which runs in a stationary track by means of a drive cam, and which can be rotated by means of a guide bar articulated with the barrier and pivoted to the gatepost, which gate is distinguished by the fact that when the barrier is in closed position the track displays a more or less horizontal component, a curvilinear transition piece, a component with straight vertical components, and a curvilinear mouth, and that the guide bar is positioned within the gatepost and is aligned perpendicular to the barrier when the latter is in closed position.

Another embodiment of the invention relates to a gate, particularly for entrance ways, roads, or the like, with a barrier which is swivel-mounted near one of its ends so that it can be rotated approximately 90° perpendicular to its longitudinal axis by means of a winch, and with a drive motor and drive mechanism for the purpose of swinging the barrier, wherein the gate is distinguished by the fact that the guide bar is equipped with a rigidly connected counter-bar, displaced by approx. 180° in the rotational direction, which comes to rest on a stationary catch when the barrier reaches its horizontal position and which permits, in place of the further rotation of the guide bar around the stationary pivot, the swinging of the guide bar around the catch and thus the horizontal movement of the harrier, and that two rollers are positioned within the barrier and are attached to a swinging plate articulated with gatepost.

A further embodiment of the invention relates to a gate, particularly for entrance ways, roads, or the like, with a gatepost and with a barrier which can be rotated at the gatepost side by means of guide bar pivoted to the barrier, which gate is distinguished by the fact that the end closest to the gatepost runs in a horizontally aligned track by means of a drive element, chain, and toothed belt, and that the guIde bar runs in a track consisting of a horizontal component, a curvilinear component, and component running downward on the vertical.

Another embodiment of the invention relates to a gate, particularly for entrance ways, roads, or the like, with a gatepost and with a barrier, the gatepost end of which runs in a stationary track by means of a drive cam, and which can be rotated by means of a guide bar articulated with the barrier and pivoted to the gatepost, which gate is distinguished by the fact that when the barrier is in closed position the track for the drive cam displays a horizontal component, a curvilinear transition piece, and component running downward on the vertical; that one side of the guide bar is connected by a rod to a swivel drive and the other side of the guide bar is connected to a permanently mounted rotating arm; and that the barrier is furnished at a given distance from the first drive cam with a second cam, roller, or the like, which also moves in the track.

Another embodiment of the invention relates to a gate, particularly for entrance ways, roads, or the like, with a barrier which is swivel-mounted near one end so that it can be rotated approximately 90° perpendicular to its longitudinal axis by means of a winch, and with a drive or drive mechanism for pivoting the barrier, wherein the barrier consists of two parts: the actual barrier and a relatively short elbow which are connected by a joint and are held together at an angle of 90° by means of a tension spring; and that the other end of the elbow is swivel-mounted to the barrier winch; and that a support for the slide engagement of the barrier tip, before it reaches closed position or before its insertion into the casing, is positioned in front of the casing, facing the gatepost, which casing is closed at the top and accommodates the barrier tip.

The invention is described below in greater detail, based on the diagrams.

Figure 1:
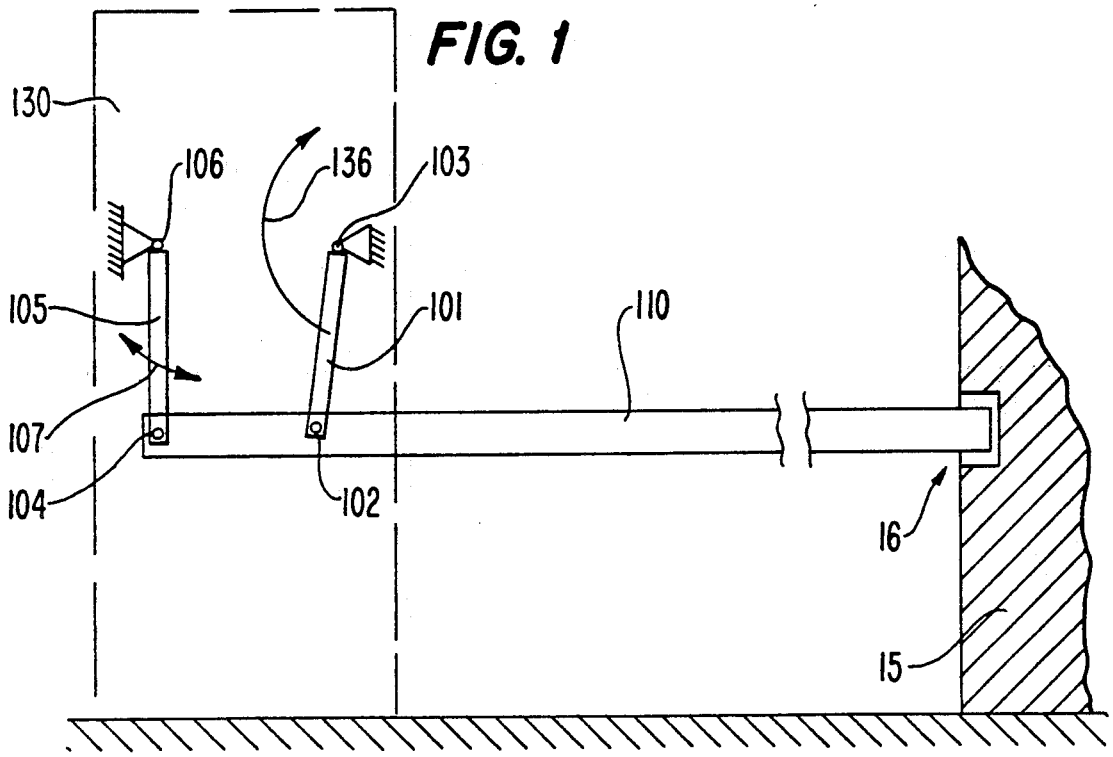
FIG. 1 shows a longitudinal section of the first embodiment of a gate according the invention.

110 in FIG. 1 designates a barrier which is swivel-mounted in a gatepost, in such a way that the barrier can be moved from the closed, horizontal position shown in FIG. 1 to a vertical position. In closed position the barrier 110, along with its tip, is located in a casing 16 which is mounted in stationary fashion in a wall 15.

Inside of the gatepost 130 a guide bar 101 is mounted to the barrier near its end; one end of the guide bar is swivel-mounted to the barrier 110 by means of a joint 102 and the other end is swivel-mounted to the gatepost 130 by means of a stationary joint 103.

A joint 104 is located at the gatepost side of the barrier 110. Attached to the joint 104 is another guide bar 105, which pivots from the post by means of a stationary joint 106.

The guide bar 101 executes a swinging motion, as indicated in the diagram by the arrow 136. In contrast, guide bar 105 performs only limited swinging movements, as indicated by arrow 107.

If the barrier 110 is moved out of the indicated position, the two guide bars 101 and 105 pivot in a clockwise direction. This releases the tip of the barrier from the casing 16. The guide bar 101 then completes the pivoting motion already begun. Point 104 of the guide bar 105, however, remains relatively stationary for a certain interval of time, allowing the barrier 110 to perform a 90° counter-clockwise rotation motion around point 104. It reaches a vertical position, whereupon the guide bar 105 executes a slight pivoting motion in counter-clockwise direction.

In horizontal position the barrier 110 shown in FIG. 1 can be received into a curved recess within the gatepost, so that it is secured in three directions, thus assuring that the barrier will not be forcibly displaced by unauthorized persons.

Figure 3:
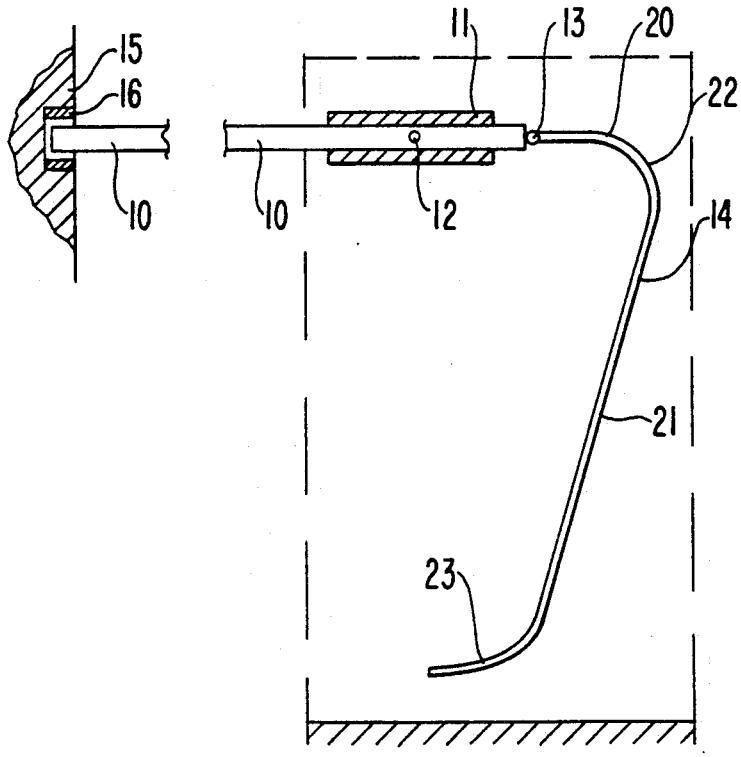
FIG. 3 shows a vertical cross section of the third embodiment of a gate according to the invention.

The numeral 10 in FIG. 3 indicates a barrier in closed horizontal position. It will be seen that the left end of the barrier 10 is positioned within a casing 16, which in turn is part of a wall 15, i.e. is permanently mounted and, in particular, is closed at the top. It is evident that the gate cannot be lifted and opened by unauthorized persons when it is in this position.

The barrier 10 within the gatepost (shown only in outline) can be rotated around a winch 12. The winch itself is not shown; it will be seen, however, that a swinging motion of about 90° around the point designated 12 can be executed perpendicular to the plane shown in the diagram.

According to the invention the barrier 10 within a casing 11 can be mounted so as allow to-and-fro motion. This means that the barrier 10 can execute longitudinal movements relative to the casing 11, in which case the casing 11 and the barrier 10 rotate around winch 12.

A cam 13 is located at the end of barrier 10. This may be a basically cylindrical pin which runs perpendicular to the plane shown in the diagram. The unattached end of this drive cam runs within track 14, which is built into a plate or other component of the gate. It can be seen that the track 14 has an initial horizontal component 20 which moves into a curvilinear transition piece 22 and then into a straight component, which runs diagonally and downward, and finally passes into a horizontal mouth.

If the drive cam 13 is set in motion, so that it executes the motion determined by track 14, the barrier 10 is first moved axially to the right. A composite motion follows, in which the tip of the barrier both swings and executes a vertical downward movement. The same takes place in area 21; the gate reaches its terminal position in the lower area 23.

To simplify the explanation, FIG. 3 shows the track 14 in schematic form only; it apparent that the cam track can be designed in a way that fulfills the user's conception.

While this motion is being executed by the gate the drive is disengaged, since the barrier motion itself allows the weight of the gate to exert a downward force which releases the drive.

Figure 2:
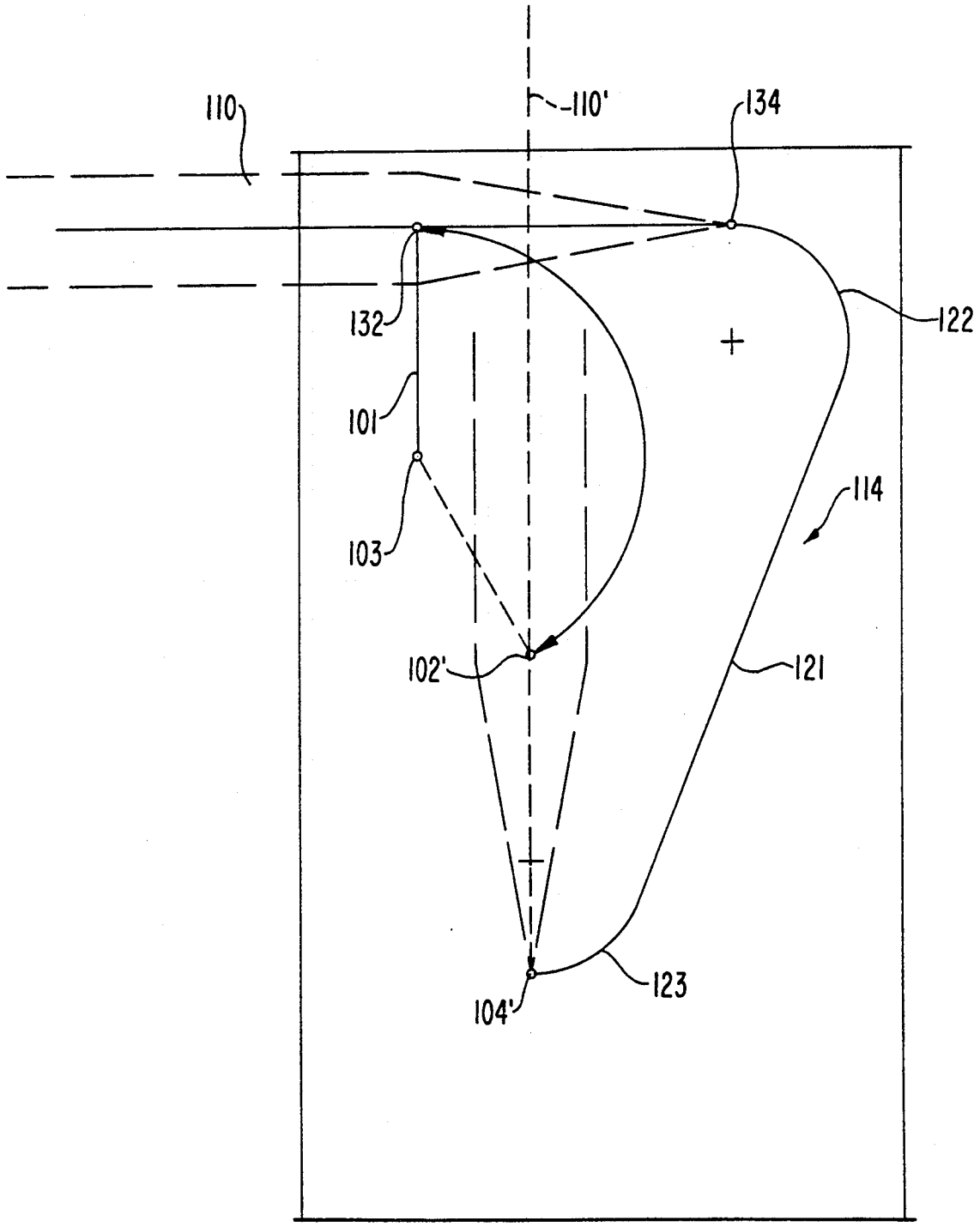
FIG. 2 shows, on a modified scale, a schematic vertical cross section of the second embodiment of a gate according to the invention.

The embodiment shown in FIG. 2 shows an outline form of the gatepost and a barrier 110 in horizontal position. A guide cam 134, which basically corresponds to that already described in connection with FIG. 3, is located at the end of the barrier 110. The guide cam 134 runs in a track 114 which has a curvilinear area 122, as well as a component 121 which runs downward on a diagonal, and a curvilinear mouth 123.

At 132 a guide bar 101 is coupled to the barrier 110; it is permanently mounted, but in articulated fashion, next to 103. In open position point 132 runs on an arc to terminal position 102'. At the same time the guide cam 134 runs in track 114 until it reaches the lower position 104'. Here the barrier rests in vertical position 110'.

If the path of motion of point 102 and point 104 is observed, it will be seen that a relatively high resolution of the swinging action is possible during the opening process. The barrier's characteristics of motion can be optimized through a suitable choice of lengths for guide bar 101 and of shapes for track 114.

In place of a track 112 with two ends it is possible to use a closed (continuous) cam track, so that the drive cam runs on a closed track, thereby requiring only a unidirectional drive. According to the invention, it would also be possible to use a chain with a pin, which in turn is connected to the drive cam at the end of the barrier. In this fashion a chain driven in a specific track would produce the desired barrier movement.

In another embodiment of the gate according to the invention the barrier, rather than turning on a pivot which passes through the barrier, turns on a pivot positioned at a certain distance from the barrier winch. The connection is produced by means of a guide bar which runs in the vertical direction when the barrier is in open position. This drive mechanism guarantees especially favorable characteristics of motion for the gate, as defined above at the beginning.

210 in the figures indicates a gatepost which generally stands upright approximately 1 meter from the ground. A barrier is swivel-mounted to this post and can be swung into vertical position from the horizontal position shown in FIG. 4. The barrier can have any desired shape; in the area shown in FIGS. 4 and 5, however, it has the shape of a hollow box, as can be seen from FIG. 5.

At the upper limit of the area within the barrier 211 two rollers 213 and 214 run from below through an opening in the barrier 211. The two rollers 213 and 214 are attached in articulated fashion to a swinging plate 212, which in turn is attached in the same fashion to the post 210 at 215. It can be seen that the carrying plate 212 participates in the swinging movement of the barrier 211, and that the arrangement of rollers 213 and 214 in barrier 211 affords the possibility of moving the barrier 211 horizontally as indicated for example, by the X in FIG. 4. How this motion comes about is described below.

A guide bar 220 which pivots at 221 is mounted at 222 on the left end of barrier 211. This is indicated by the arrow in FIG. 1. It is evident that a 180° counterclockwise turning motion of the guide bar 220 will move the barrier 211 from the horizontal position shown in FIG. 4 to a vertical position.

Figure 4:
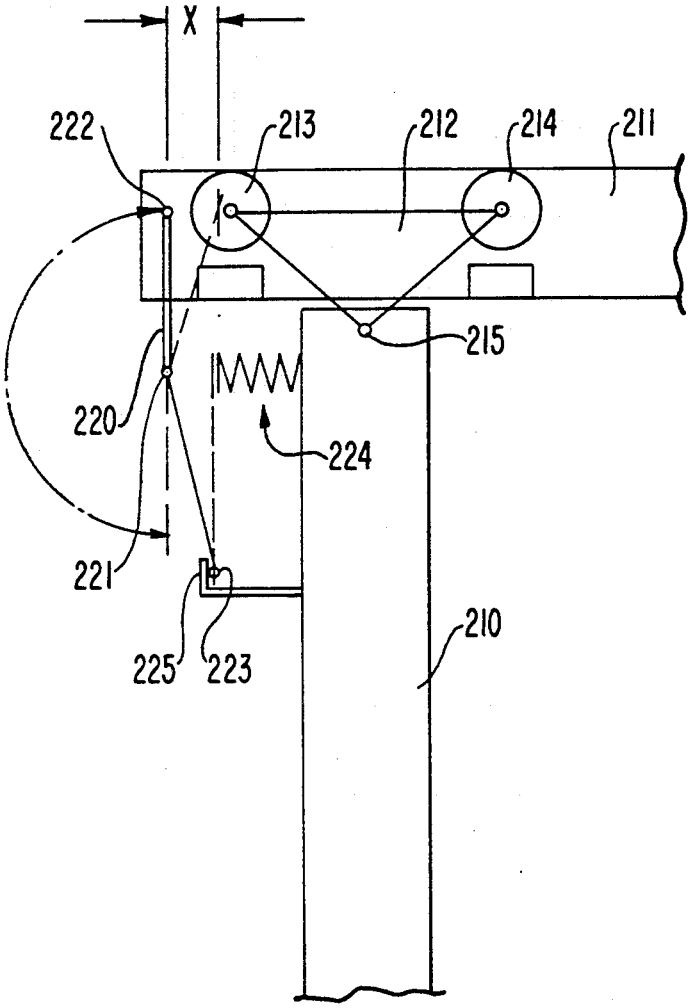
FIG. 4 shows a lateral view of the fourth embodiment of a gate according to the invention.
Figure 5:
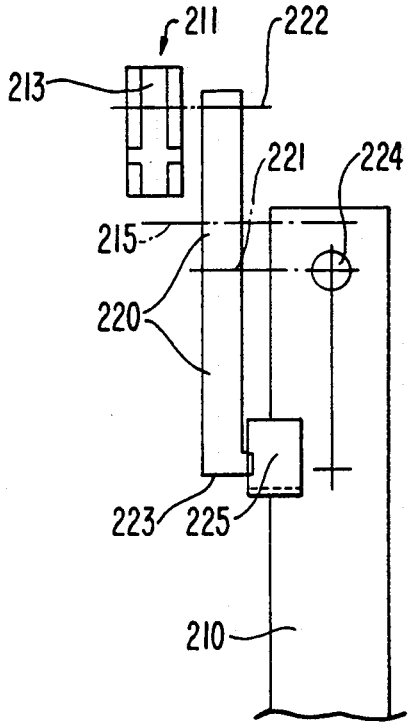
FIG. 5 shows a section of the gate depicted in FIG. 4.

The shape of the guide bar 220 is that of a double lever, i.e. it extends more or less diametrically relative to the part between joints 221 and 222. There is a further part which projects downward (see FIG. 4); a portion of this lower component represents a diagonally extending pin, tension element, or the like. In the position shown in FIG. 4 this pin 223 is located at a stop 225. FIG. 4 shows the barrier 211 immediately before completion of the closing motion; here the barrier 211 is already in horizontal position. Up to this point in time the guide bar 220 is driven in clockwise direction, and the upper part of the guide bar 220 has reached vertical position, as shown in FIG. 4. The driving impulse, which works around pivot 221, attempts to further turn the upper part of guide bar 220 in clockwise direction; this is impossible, however, since the pin 223 rests against the stop 225. The drive consequently swings the guide bar 220 around the pivot 223, likewise in the clockwise direction. This results in a motion in which the attachment point 222 is moved to the right over distance X, shown in FIG. 4. In other words, the barrier 211 executes a horizontal motion, so that the tip of the barrier (not shown) can be inserted into a casing.

The motion thus described is finally completed when the guide bar 220 acts upon a spring 224 which counteracts the motion.

During the opening process, the barrier 211 (shown in FIG. 4) first executes a horizontal motion from right to left in the reverse direction. This initial motion is supported by the coiled spring 224. Upon reaching the position shown in FIG. 4, however, the driving impulse working around the pivot 221 causes the point of attachment 22 to execute a purely rotational motion along the indicated arc, so that the barrier 211 is moved into vertical position.

Figure 6:
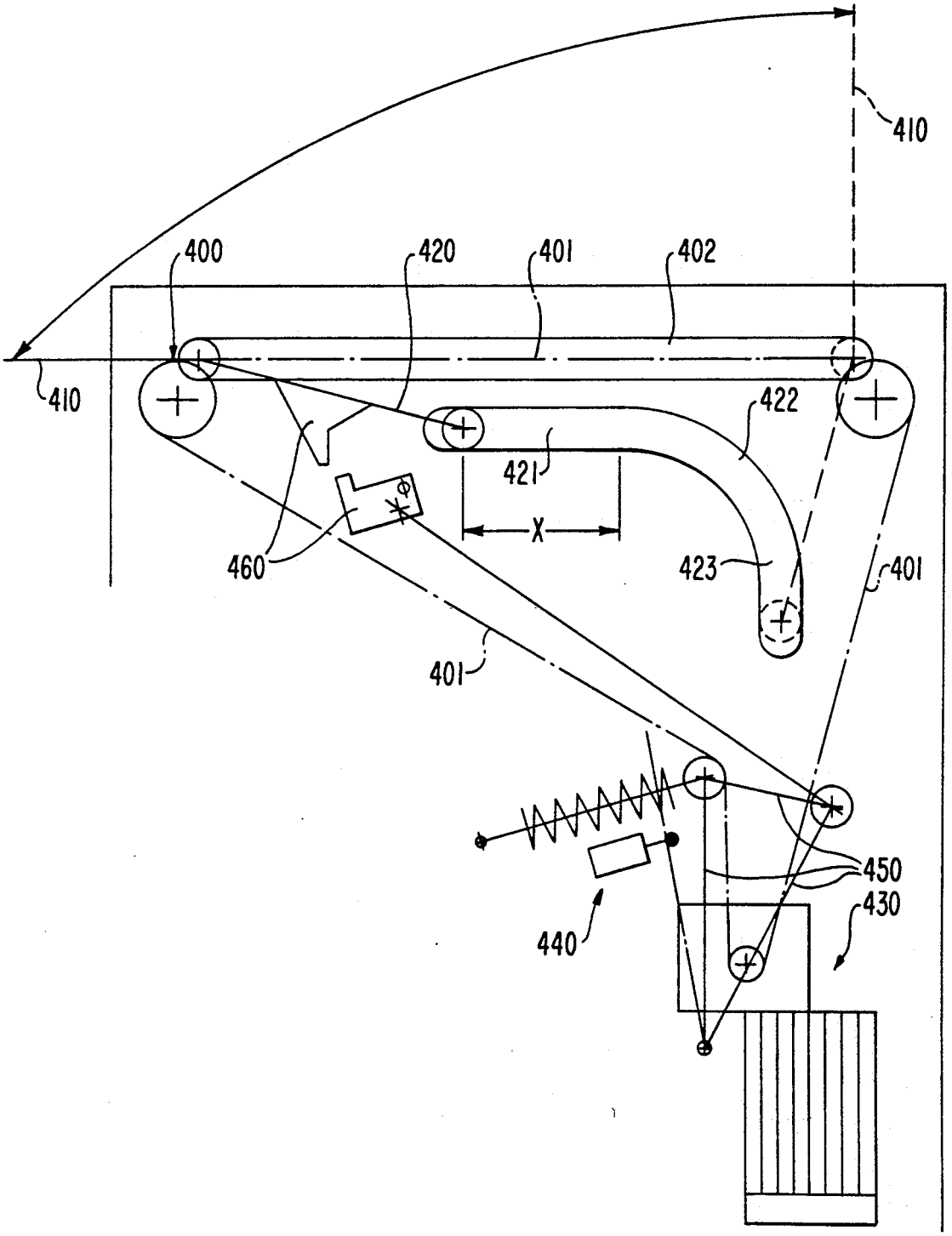
FIG. 6 shows a schematic view of a fifth embodiment of a gate according to the invention.

In FIG. 6 the barrier is suggested by its pivot 410. The end opposite the tip of the barrier is designated 400; mounted to this end is a continuous chain which runs on deflection wheels and is driven by a reversing drive 430.

The end 400 of the barrier runs in a horizontal track 402. A guide bar 420 is coupled to the end 400 of the barrier; the other end of the guide bar runs in a track which displays a horizontal zone 421 of length X, a curvilinear part 422 running downward, and a part 423 running downward on the vertical.

If the end 400 of the barrier is moved to the right in track 402 for the purpose of opening the gate—in which case the free end of guide bar 420 reaches the end of 423—the pivot of the barrier assumes the vertical direction 410 shown in the figure. It is evident that the tip of the barrier (not shown), beginning from closed position, executes a purely horizontal motion through distance X of tracks 402 and 421.

450 indicates a gear that turns on a pivot and holds rollers for the chain 401, such that the gear 450 responds to the tension in chain 420 when the drive 430 is cut on.

460 indicates locking and ratchet parts which make it possible to lock the barrier in horizontal position. The locking parts 460 respond to tension in the chain 401, so that as the opening motion begins, the locking parts 460, aided by the spring and an over-and-under relay, reach the open position shown in FIG. 6, thus permitting the gate to be opened.

Figure 7:
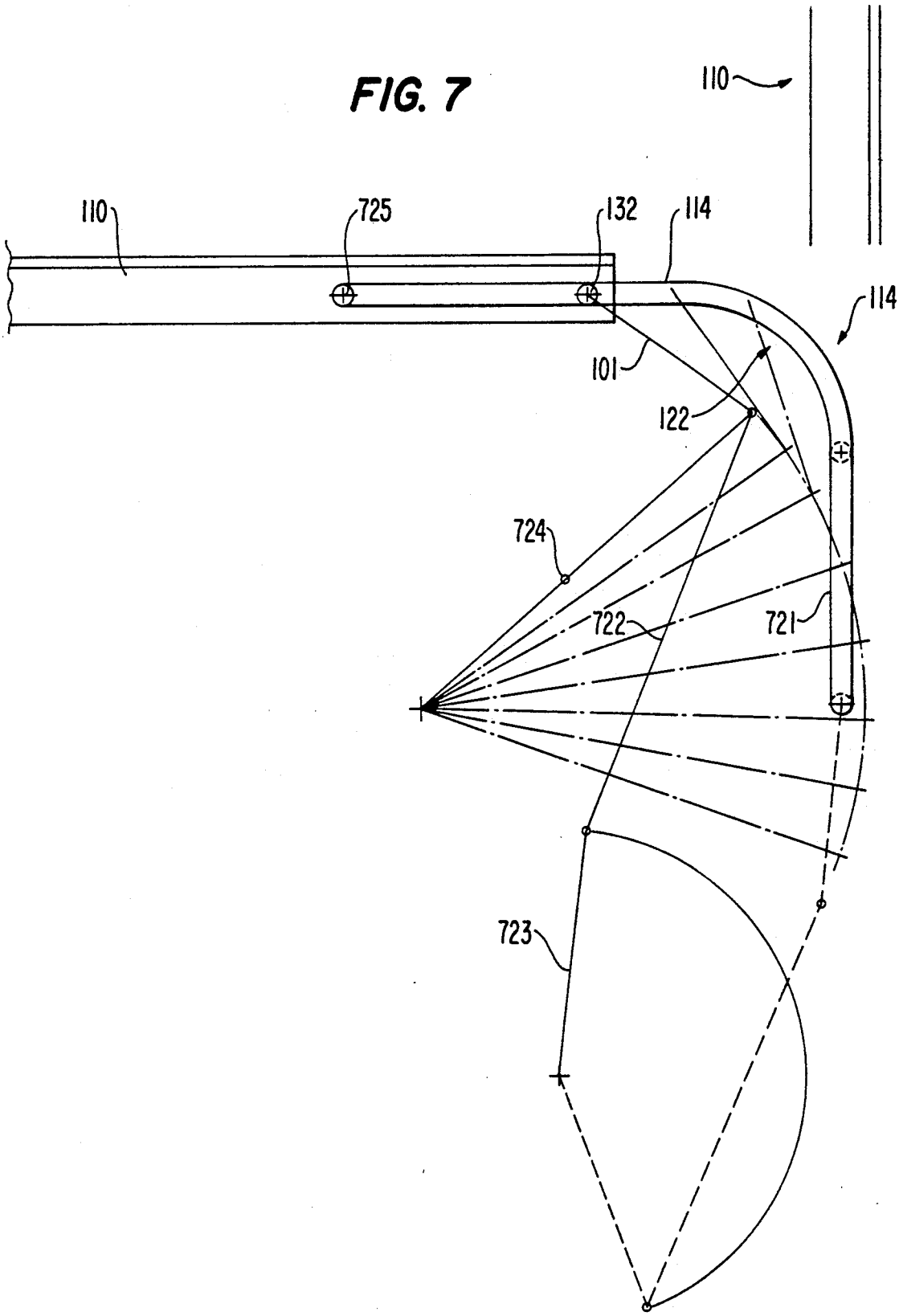
FIG. 7 shows a schematic view of a sixth embodiment of a gate according to the invention.

The embodiment shown in FIG. 7 shows parts already contained in the embodiment shown in FIG. 2; the same reference numbers have been used in both cases.

The drive cam 132 is articulated with a stationary rotary arm 724 by means of the guide bar 101, but also with another bar 722.

The other end of rod 722 is articulated with a rotary arm 723. Finally, another cam 725 is mounted to the barrier 110 near drive cam 132; the second cam 725 also runs in track 114.

The movement of the swivel drive 723 causes the barrier 110 to leave its horizontal position and to execute a purely axial movement, until it reaches its vertical position.

Figure 8:
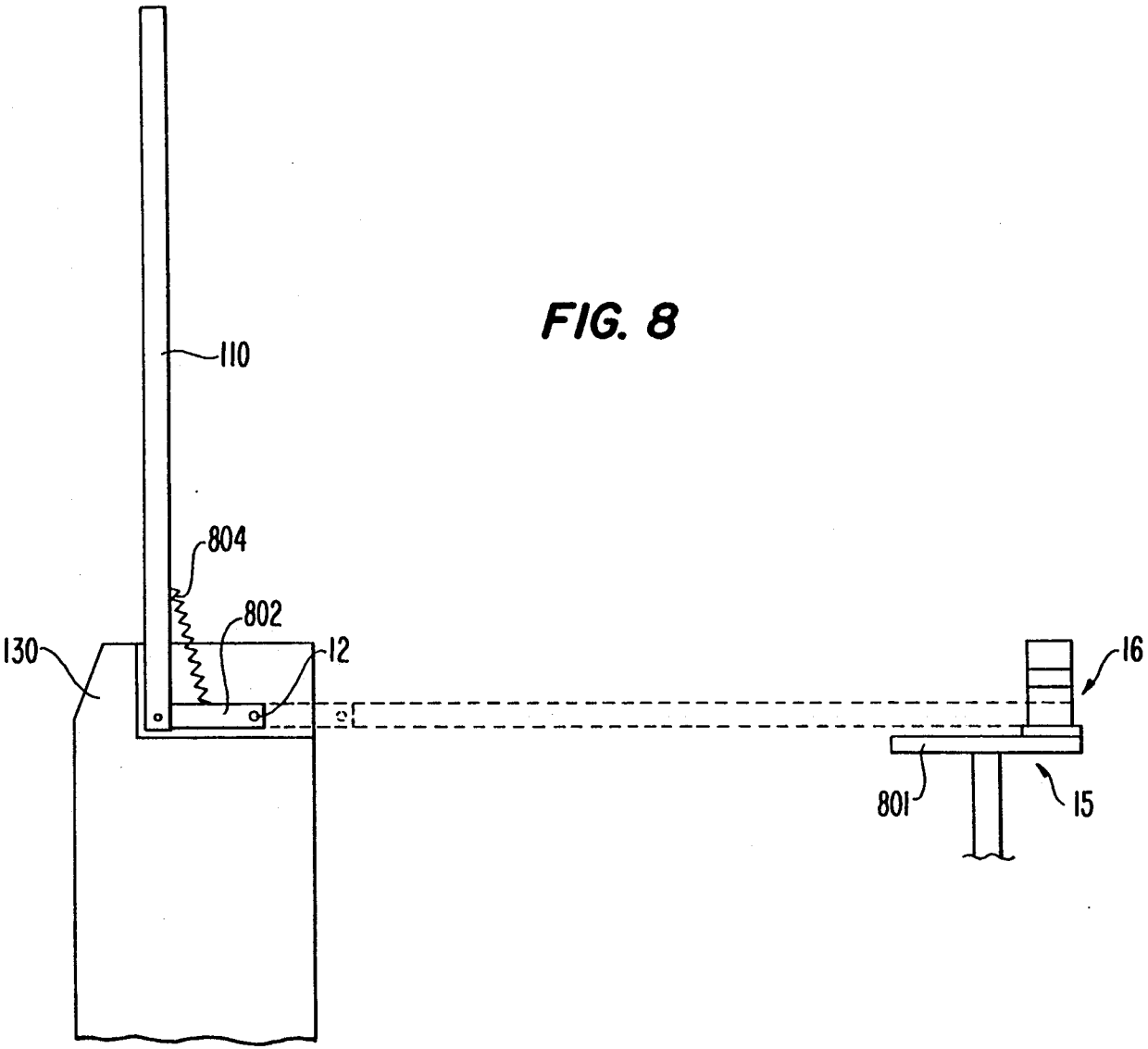
FIG. 8 shows a schematic view of a seventh embodiment of a gate according to the invention.

FIG. 8 shows an embodiment in which the barrier consists of two parts, specifically part 110 and an elbow 802. Both parts are held in position by a spring 804, at a 90° angle. The elbow 802 is driven by the winch 12, which is mounted in the gatepost 130. In the relative position of parts 802 and 110 shown in FIG. 8, the gate tip reaches surface 801, which leads into a casing 16; the casing is secured to a mount 15 for the gate tip. With a further rotating movement of the elbow 802 the barrier 110, counteracting the influence of the spring 804, turns toward the elbow 802, so that the gate tip enters into casing 16.

I claim:

1. A gate for controlling passage through a passageway comprising:

a gatepost;

a barrier having a length and first and second opposite ends, said barrier being movable between a closed position, in which said barrier extends across the passageway, and an open position, in which said barrier is out of the passageway;

fixed means for preventing movement of said barrier transverse to the length of said barrier, said fixed means receiving one of the ends of said barrier in the closed position of said barrier; and means for mounting said barrier on said gatepost for movement in a plane from said closed position, substantially solely in a direction parallel to the length of said barrier until said barrier is out of said fixed means, to said open position.

2. The gate according to claim 1, further comprising means for moving said barrier from said closed position to said open position, said moving means being adjacent to said mounting means.

3. The gate according to claim 1, wherein said fixed means comprises an opening facing said barrier and extending in a direction coaxial with the length of the barrier in said closed position.

4. The gate according to claim 1, wherein said gatepost is positioned on one side of the passageway, and said fixed means is positioned on a side of the passageway opposite to said gatepost.

5. The gate according to claim 1, wherein the length of said barrier extends across the passageway.

6. The gate according to claim 1, wherein said barrier extends completely across the passageway.

7. The gate according to claim 1, wherein said mounting means comprises a casing, said barrier being supported in said casing for axial movement relative to said casing.

8. The gate according to claim 1, wherein said mounting means comprises a first guide bar having a first portion pivotally connected to said gatepost at a first point and a second portion pivotally connected to said barrier at a second point, said second portion being spaced from said first portion, said mounting means further comprising a second guide bar having a first portion pivotally connected to said gatepost at a third point spaced from said first point and a second portion pivotally connected to said barrier at a fourth point spaced from said second point, said second portion of said second guide bar being spaced from said first portion of said second guide bar.

9. The gate according to claim 8, wherein said barrier is horizontal in said closed position.

10. The gate according to claim 9, wherein said first portions of said first and second guide bars are higher than said second portions of said guide bars.

11. The gate according to claim 10, wherein said guide bars have different lengths from one another.

12. The gate according to claim 1, wherein said mounting means comprises a cam connected to said barrier and a cam track defined on said support, said cam being received in said cam track to follow along said cam track.

13. The gate according to claim 12, wherein said cam is located at the other of the ends of said barrier.

14. The gate, particularly for entrance ways, roads, and the like, comprising:

a gatepost;

a barrier having a first end adjacent to said gatepost and a second end;

means for movably mounting said barrier on said gatepost, said mounting means comprising a first guide bar having a first portion pivotally connected to said gatepost at a first point and a second portion pivotally connected to said barrier at a second point, said second portion being spaced from said first portion, said mounting means further comprising a second guide bar having a first portion pivotally connected to said gatepost at a third point spaced from said first point and a second portion pivotally connected to said barrier at a fourth point spaced from said second point, said second portion of said second guide bar being spaced from said first portion of said second guide bar; and means for receiving said second end of said barrier.

15. A gate for controlling passage through a passageway comprising:

a gatepost;

a barrier having a length and first and second opposite ends, said barrier being movable between a closed position, in which said barrier extends in a first direction across the passageway, and an open position, in which said barrier is out of the passageway;

fixed means for preventing movement of said barrier transverse to said first direction, said fixed means receiving one of the ends of said barrier in the closed position of said barrier; and means for mounting said barrier on said gatepost for movement in a plane from said closed position to said open position such that said one end moves substantially solely in a direction parallel to said first direction until said barrier is out of said fixed means.

16. A gate for controlling passage through a passageway, comprising:

a barrier having first and second ends and a longitudinal axis;

a support;

means for mounting said barrier on said support adjacent to one of said ends of said barrier for movement parallel to the longitudinal axis of the said barrier and pivotally with respect to said support, said mounting means comprising a cam connected to said barrier and a cam track defined on said support, said cam being received in said cam track to follow along said cam track, said cam track having a horizontal portion, a curvilinear transition portion, and a straight portion having a vertical component; and fixed means for preventing movement of said barrier transverse to said longitudinal axis, said fixed means being positioned on an opposite side of the passageway from said support, said fixed means receiving the other of said ends of said barrier.

* * * * *